US006060961A

United States Patent [19]

Moheb et al.

[11] Patent Number: 6,060,961

[45] Date of Patent: May 9, 2000

[54] CO-POLARIZED DIPLEXER

[75] Inventors: Hamid Moheb, Clemmons; Colin Michael Robinson, Conover, both of N.C.

[73] Assignee: Prodelin Corporation, Conover, N.C.

[21] Appl. No.: 09/148,665

[22] Filed: Sep. 4, 1998

Related U.S. Application Data

[60] Provisional application No. 60/074,701, Feb. 13, 1998.

[51] Int. Cl.[7] ..... H01P 1/161

[52] U.S. Cl. ..... 333/126; 333/214; 333/135; 343/756; 370/297

[58] Field of Search ..... 333/122, 126, 333/135, 21 A; 343/756; 370/297

[56] References Cited

U.S. PATENT DOCUMENTS

| | | | |
|---|---|---|---|
| 3,204,205 | 8/1965 | Rowland | 333/135 |
| 4,366,453 | 12/1982 | Schwarz | 333/125 X |
| 4,427,953 | 1/1984 | Hudspeth et al. | 333/134 |
| 4,546,471 | 10/1985 | Bui-Hai | 333/21 A X |
| 4,591,088 | 5/1986 | Mulliner et al. | 29/600 X |
| 4,920,351 | 4/1990 | Bartlett et al. | 343/756 |
| 5,162,808 | 11/1992 | Kim | 343/786 |
| 5,276,456 | 1/1994 | Kim | 333/78 |
| 5,335,363 | 8/1994 | Basciano | 333/135 X |
| 5,471,177 | 11/1995 | Hudspeth et al. | 333/126 |
| 5,576,670 | 11/1996 | Suzuki et al. | 333/126 |

FOREIGN PATENT DOCUMENTS

| | | | |
|---|---|---|---|
| 98-192 | 1/1984 | European Pat. Off. . | |
| 2704358 | 10/1994 | France . | |
| 60-1902 | 1/1985 | Japan . | |
| 62-51801 | 3/1987 | Japan . | |
| 6-85502 | 3/1994 | Japan | 333/21 A |

*Primary Examiner*—Justin P. Bettendorf
*Attorney, Agent, or Firm*—Alston & Bird LLP

[57] ABSTRACT

An apparatus and associated method of manufacture for coupling a receiver and a transmitter to a single antenna feed horn so as to allow for the simultaneous transmission and reception of co-polarized signals, such as in a radio frequency communications system, are provided. To separate the two co-polarized signals of different frequencies, the apparatus comprises a waveguide junction, a first filter tuned to the transmit signal frequency, and a second filter tuned to the receive signal frequency. The apparatus may be manufactured using low-cost reusable-mandrel casting techniques.

18 Claims, 4 Drawing Sheets

10
7
6
12
14
16
IDU
INROUTE (UPLINK)
OUTROUTE (DOWNLINK)
TRANSIT (UPLINK)
RECEIVE (DOWNLINK)
HUB
5

CO-POLARIZED DIPLEXER

CROSS-REFERENCE TO RELATED APPLICATIONS

This application claims the benefit of U.S. Provisional Application No. 60/074,701, filed Feb. 13, 1998.

FIELD OF THE INVENTION

The present invention relates to frequency-selective antenna equipment and associated methods of manufacture for simultaneously transmitting and receiving microwave frequency signals through free space, especially to and from a satellite.

BACKGROUND OF THE INVENTION

Satellite communications (satcom) systems operating at microwave carrier frequencies (between 3 GHz and 300 GHz) typically employ parabolic reflector antennas through which signals from the satellite (downlink signals) are received while signals to the satellite (uplink signals) are simultaneously transmitted. The parabolic reflector is typically illuminated for both the uplink and the downlink by a single feed horn that supports all signal polarizations. In most satcom systems, the uplink signal frequency is somewhat higher than the downlink signal frequency. In typical Ku-band systems, for example, the uplink frequency is commonly in the range 14.0 GHz–14.5 GHz while the downlink frequency is commonly in the range 10.95 GHz–12.75 GHz.

In most satcom systems, the uplink signal polarization is specified by the communications system to be orthogonal to the polarization of the downlink signal in order to minimize cross-talk between the uplink and downlink signals. In these cross-polarized systems, the circular waveguide feed horn is connected to an orthomode transducer (OMT) to separate the orthogonally polarized uplink and downlink signals. The OMT may also include a transmit frequency band reject filter in the receive arm of the OMT. Each of the orthogonal arms of the OMT is in turn connected to an associated filter and to separate receiver and transmitter hardware in rectangular waveguide.

Some satcom systems are designed so that the uplink and downlink signals have the same polarization (i.e. they are co-polarized), even though associated signal cross-talk problems may thus be encountered. In one approach to antenna hardware for such a co-polarized system, the set of feed horn, OMT and filter hardware used for the more common cross-polarized systems may be easily adapted by inserting a co-polarization (co-pol) adapter (such as Prodelin TD0362 Co-Pol Adapter) between the feed horn and the OMT. The co-polarization adapter comprises a 90 degree waveguide twist and orthogonal waveguide filter arms that force the uplink and downlink signals to appear at the OMT to be orthogonally polarized signals. While this approach takes advantage of common waveguide components from the more-common cross-polarized system, the co-pol adapter adds considerable cost, weight, insertion loss and size to the feed assembly.

In a simpler alternative approach, a single-piece co-polarized diplexer (such as Prodelin TD0361 Co-Pol Diplexer) connected between the feed horn and the transmitter and receiver hardware is used to frequency-select the uplink and downlink signals and to connect to separate transmitter and receiver hardware. A co-pol diplexer uses waveguide filters and a waveguide junction to separate the (co-polarized) uplink and downlink signals presented to the co-pol diplexer in square waveguide and to feed separate transmitter and receiver hardware in rectangular waveguide. While the co-pol diplexer provides a fairly simple solution to the problem of uplink and downlink separation in a co-polarized satcom system, electrical performance requirements have dictated that known co-pol diplexer designs be manufactured using expensive electroforming or machining techniques because of the complex geometry required.

While known co-pol diplexers offer advantages relative to other techniques used for uplink and downlink signal separation in a co-polarized satcom system, significant cost is incurred to electroform or machine the co-pol diplexers of known designs. In many very small aperture terminal (VSAT) and other satcom terminal applications, the cost of a complex electroformed or machined part may be a significant proportion of overall satcom terminal cost. Therefore, while a single-piece co-pol diplexer has been developed, it is still desirable to develop an improved co-pol diplexer that does not suffer from the inherent limitations imposed by prior co-pol diplexer designs, such as disproportionate cost. Because large numbers of co-pol diplexers are needed in order to meet the needs of the global satcom market, there is a strong need for a co-pol diplexer that can be manufactured at a reduced cost.

SUMMARY OF THE INVENTION

An apparatus for coupling a receiver and a transmitter to a single antenna so as to allow for the simultaneous transmission and reception of co-polarized signals is provided. The apparatus comprises a waveguiding structure defining a junction for separating a first signal having a first frequency and a second signal having a second frequency in the waveguiding structure. The first and second signals are co-polarized and the first frequency is different from the second frequency. The apparatus further comprises a first filter, connected to the waveguiding structure, for filtering the first signal, and a second filter, connected to the waveguiding structure, for filtering the second signal. So that the apparatus may be manufactured using low-cost reusable-mandrel casting techniques, all internal surfaces of the apparatus are visible from some point external to the apparatus.

A method for manufacturing a co-polarized diplexer is also provided. The method comprises positioning within a casting mold at least one mandrel configured to form a mold cavity defining a waveguiding structure, the waveguiding structure including a junction for separating first and second co-polarized signals at different frequencies. The method further comprises filling the mold cavity of the casting mold with a hardenable casting composition to form the co-polarized diplexer about the at least one mandrel, and slideably removing the at least one mandrel from the waveguiding structure after the hardenable casting composition has hardened.

The co-pol diplexer of the present invention improves significantly upon the design and fabrication methods for existing co-pol diplexers because all internal surfaces of the co-pol diplexer of the present invention are visible from some point external to the co-pol diplexer. The co-pol diplexer of the present invention thus may be manufactured by low-cost reusable-mandrel casting techniques rather than the expensive electroforming or machined assembly techniques required to fabricate conventional co-pol diplexers.

DETAILED DESCRIPTION OF THE ILLUSTRATED EMBODIMENT

The present invention will now be described more fully with reference to the accompanying drawings, in which preferred embodiments of the invention are shown. This invention may, however, be embodied in many different forms and should not be construed as limited to the embodiments set forth here; rather, these embodiments are provided so that this disclosure will be thorough and complete and will fully convey the scope of the invention to those skilled in the art. Like numbers refer to like elements throughout.

Those skilled in the art will recognize that the present invention will also be useful in a variety of radar, electronic warfare, remote sensing and other applications, including in communications applications other than satcom applications, and that the Ku-band embodiment of the present invention described in detail herein may be easily adapted to other frequency bands without departing from the present invention. The present invention may, for example, be adapted to the C-band, the Ka-band or other frequency bands. For purposes of illustration, though, the present invention is described herein with reference to a Ku-band embodiment.

Figure 1:
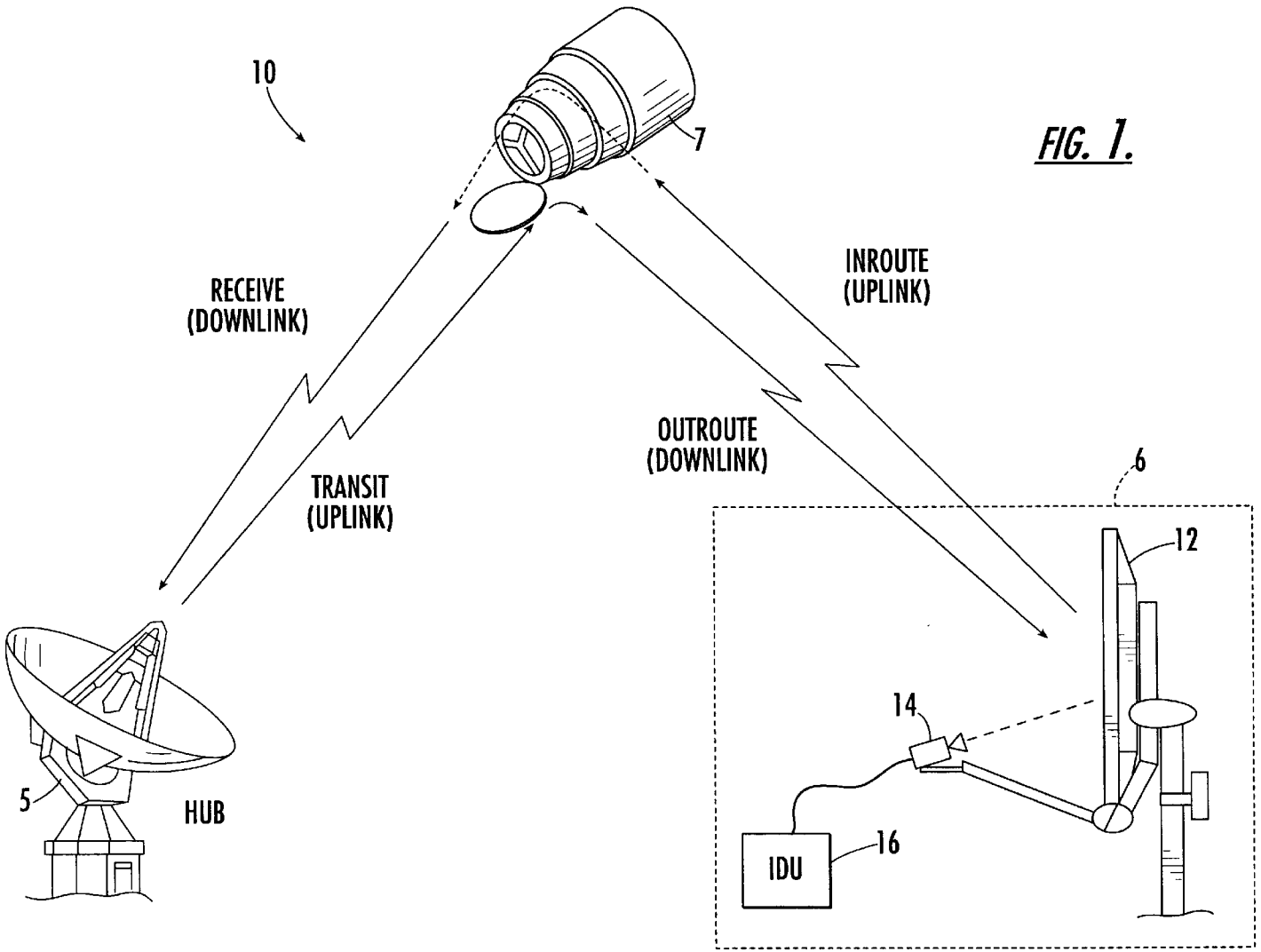
FIG. 1 is a schematic representation of the basic elements in a satellite communications system, including a satellite, a hub and a terminal.

Satcom network 10, illustrated in FIG. 1, comprises a central hub 5, a communications satellite 7, and a plurality of terminals 6, only one of which is shown. Satcom network 10 provides a two-way communications system for relaying communications signals, such as voice and data signals, between central hub 5 and terminals 6 via communications transponders located in communications satellite 7.

As shown in FIG. 1, communications satellite 7 functions as a microwave relay, receiving microwave signals from central hub 5 and terminal 6 modulated onto an uplink frequency, downconverting those signals to a downlink frequency, and then transmitting the modulated downlink signal to central hub 5 or terminal 6, as appropriate. In a typical satcom network 10, a particular microwave band is assigned for each of the downlink signal and the uplink signal and each band may be further subdivided to allow assignment of channels to various communications network users.

In one embodiment, terminal 6 comprises a very small aperture terminal antenna reflector 12 for collecting downlink signals from and directing uplink signals to the communications satellite 7. The terminal also generally includes an outdoor unit (ODU) 14 typically located near or with the antenna, and an indoor unit (IDU) 16. The IDU 16 is typically located inside a shelter or building within a few yards of the location of antenna reflector 12 and ODU 14. ODU 14 typically comprises a transmitter chain for amplifying and frequency multiplying a modulated signal and a receiver chain for receiving and demodulating downlinked signals.

Figure 2:
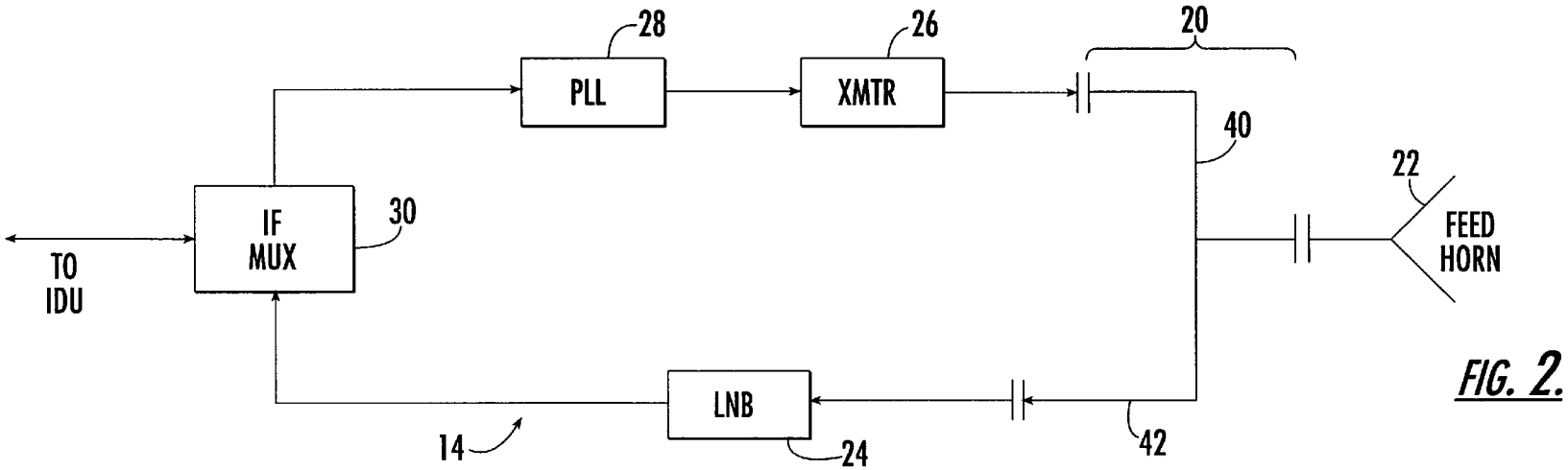
FIG. 2 is a schematic diagram of an outdoor unit (ODU) and feed horn showing the basic intermediate frequency and microwave frequency functional blocks in a satcom terminal.

FIG. 2 is a schematic diagram of ODU 14 depicting the co-pol diplexer 20 of the present invention along with feed horn 22, low noise block downconverter (LNB) 24, transmitter 26, phase lock loop (PLL) 28, and intermediate frequency (IF) multiplexer 30. For signal transmission, uplink voice and data signals are modulated by a modulator in IDU 15 onto an IF signal routed by IF multiplexer 30 from IDU 15 to PLL 28. PLL 28 uses phase locking to frequency stabilize the modulated IF signal before applying the signal to the input of transmitter 26. Transmitter 26 frequency multiplies and amplifies the modulated IF signal to produce a high-power microwave-frequency uplink signal modulated by the IF signal. The output of transmitter 26 is fed to uplink arm 40 of co-pol diplexer 20, which routes the uplink signal to feed horn 22.

For signal reception, downlink voice and data signals are collected by feed horn 22 and applied to co-pod diplexer 20, which routes the downlink signal through downlink arm 42 of co-pol diplexer 20 and then to LNB 24. LNB 24 in turn low-noise amplifies and frequency divides the downlink signal to generate a modulated IF signal. IF multiplexer 30 in turn routes the modulated IF signal to IDU 15.

The co-pol diplexer 20 of the present invention functions to couple transmitter chain signals and receiver chain signals with feed horn 22 to enable the simultaneous transmission and reception of uplink and downlink signals, respectively, through terminal 6 in satcom network 10.

Figure 3:
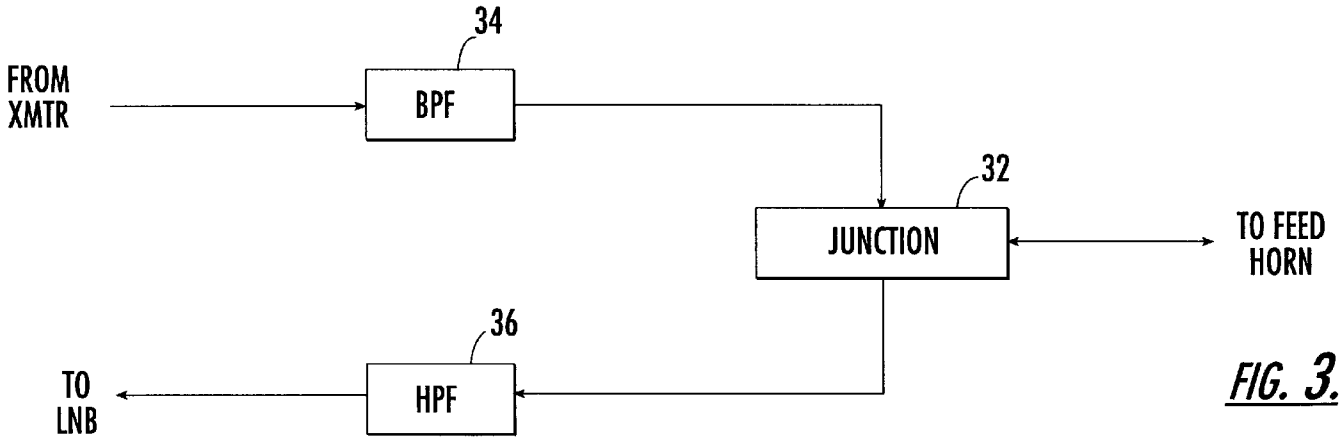
FIG. 3 illustrates schematically the co-pol diplexer apparatus of the present invention, including the waveguide junction, the bandpass filter and the high pass filter.

The co-pol diplexer 20 of the present invention is illustrated schematically in FIG. 3, where the three microwave circuit elements of the co-pol diplexer 20 are shown: a junction 32 is formed by bifurcating a waveguide structure, a bandpass filter 34 is tuned to pass downlink frequencies, and a high pass filter 36 is tuned to pass uplink frequencies.

Figure 4:
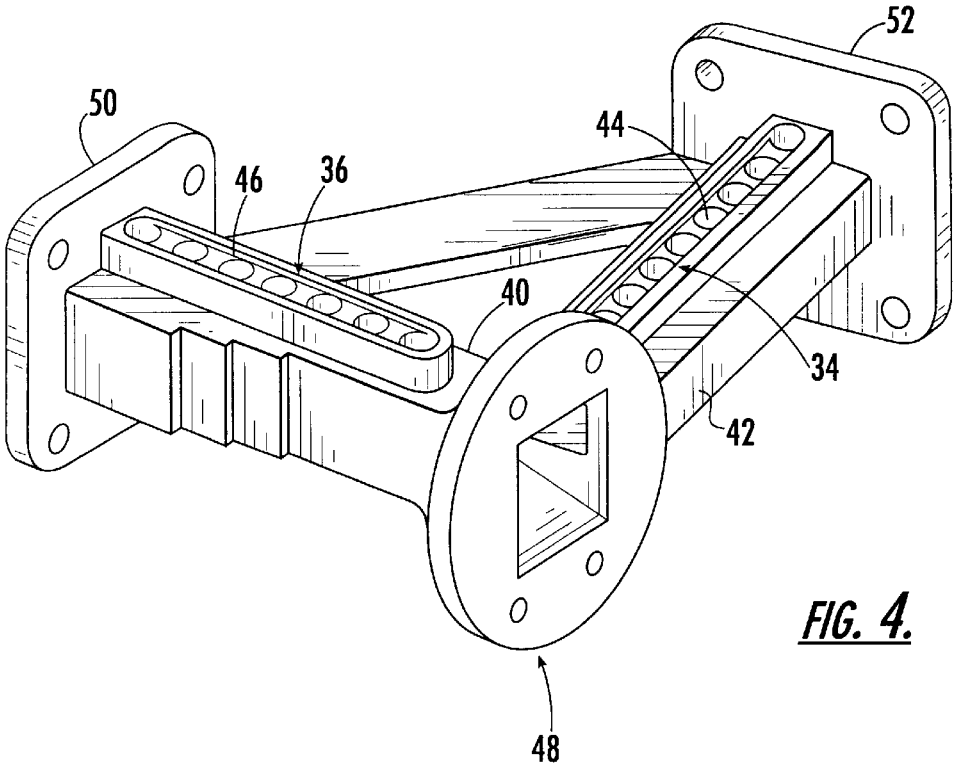
FIG. 4 is a perspective view of one Ku-band embodiment of the co-pol diplexer apparatus of the present invention.

FIG. 4 provides a perspective view of one preferred embodiment of the co-pol diplexer 20 of the present invention, wherein co-pol diplexer 20 is implemented in waveguide and constructed as an aluminum casting. As will be apparent to those skilled in the art, co-pol diplexer 20 could also be cast from electrically conductive materials other than aluminum without departing from the present invention. The waveguide structures of uplink arm 40 and downlink arm 42 are not perpendicular to each other but are instead preferably oriented at an angle of between seventy and ninety degrees in the plane of the broad wall of the waveguides of uplink arm 40 and downlink arm 42. In the illustrated embodiment, an angle of seventy seven degrees is preferable.

As will also be apparent to those skilled in the art, the co-pol diplexer 20 of the present invention could also be formed by molding a non-conductive material, such as a plastic material, and then depositing a conductive material, such as by sputtering a thin layer of aluminum, gold, copper or other conductive material, on appropriate waveguiding surfaces of the molded non-conductive material.

Feed horn flange 48 is preferably a standard round flange with a square waveguide opening and flange fastener holes designed to mate with standard feed horn flanges. Likewise, transmitter flange 50 and receiver flange 52 are preferably standard rectangular waveguide flanges designed to mate with standard waveguide flanges, such as a standard WR75 flange for Ku-band applications.

As may be seen in FIG. 4, the co-pol diplexer 20 of the present invention comprises bandpass filter 34 and high pass filter 36 for selecting downlink and uplink frequencies, respectively. Bandpass tuning screws 44 and high pass tuning screws 46 provide frequency tuning freedom to bandpass filter 34 and high pass filter 36, respectively. Tuning may be needed for at least two reasons. First, manufacturing tolerances may yield co-pol diplexers 20 with a range of frequency selectivity performance inadequate to meet system needs, and tuning can compensate for any such manufacturing shortcomings. Second, some satcom networks 10 have different frequency plans (uplink and downlink signal frequency band assignments) which can be accommodated by tuning co-pol diplexer 20 with bandpass tuning screws 44 and high pass tuning screws 46. The co-pol diplexer 20 of the present invention provides a single, mass-producible unit that can be frequency tuned to meet the needs of a range of satcom networks 10 within a given broad communications frequency band (within the Ku-band, the C-band, the X-band or the Ka-band, for example).

A principal advantage of the co-pol diplexer 20 of the present invention is that it may be cast around a reusable mandrel. Casting is a mature and very cost-effective approach to the manufacture of aluminum waveguide parts not requiring tolerances tighter than about +/−0.002 inches. In order to cast a part around a reusable mandrel, however, all internal cavities of the part must be accessible by one or more slideable reusable mandrels. Unfortunately, existing designs for co-pol diplexers 20 comprise inaccessible internal cavities and thus may not be manufactured using reusable mandrel casting techniques. Thus, conventional diplexers must be electroformed, plaster cast or machined assemblies. As a consequence of its novel design, the co-pol diplexer 20 of the present invention can be die cast around one or more slideable, reusable mandrels such that the manufacture of the tunable co-pol diplexer 20 provides significant cost advantages relative to the manufacture of conventional designs. Significantly, a single design may be manufactured in volume and tuned to meet varying satcom frequency plan requirements.

Figure 5A:
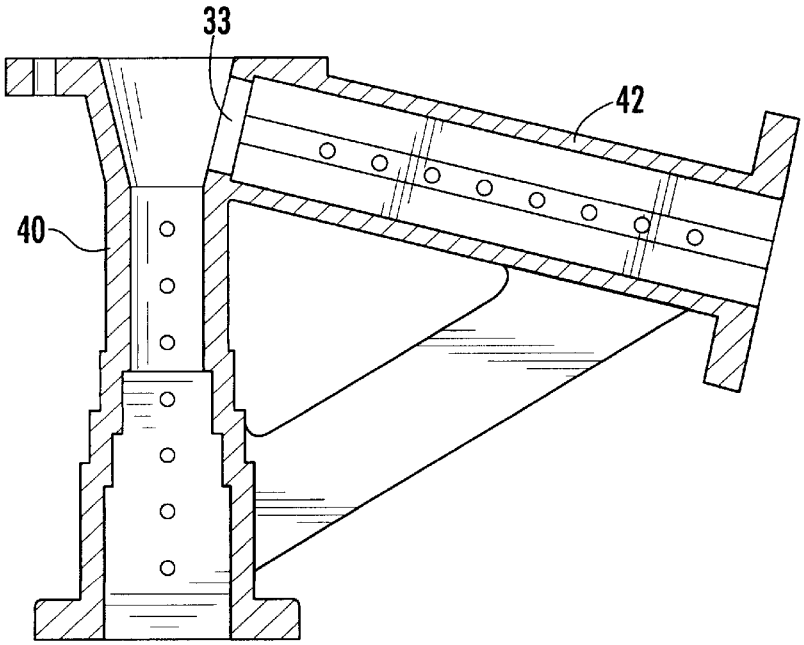
FIG. 5A is a cross-sectional view indicating the iris geometry and the locations of filter tuning screws of a Ku-band co-pol diplexer as well as the mandrel geometry for casting a Ku-band co-pol diplexer.
Figure 5B:
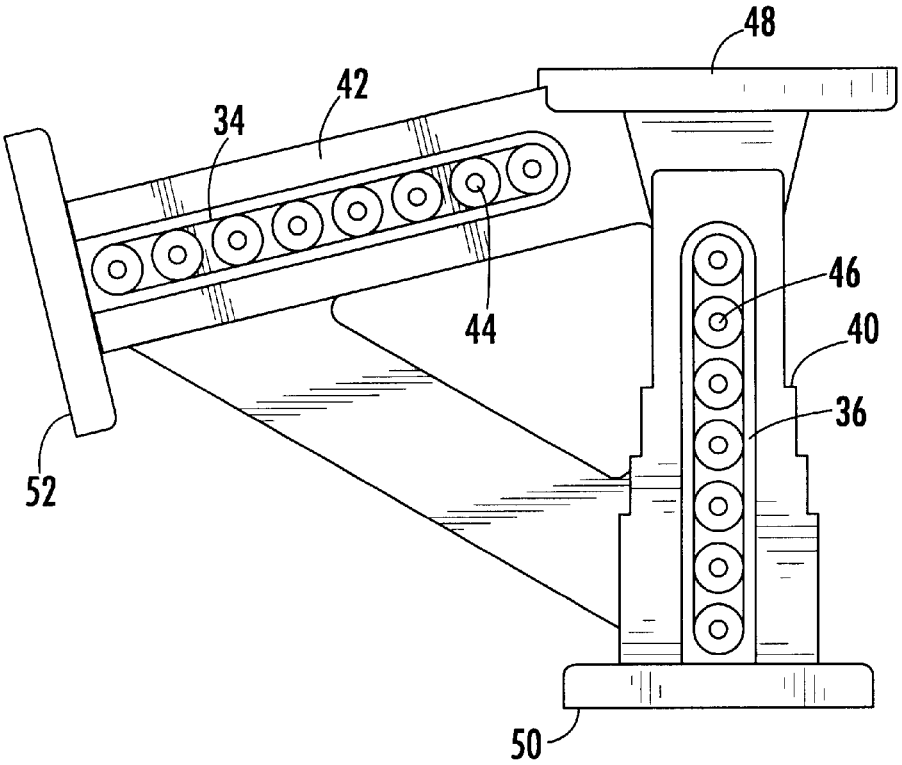
FIG. 5B is a top view of a Ku-band co-pol diplexer.
Figure 5C:
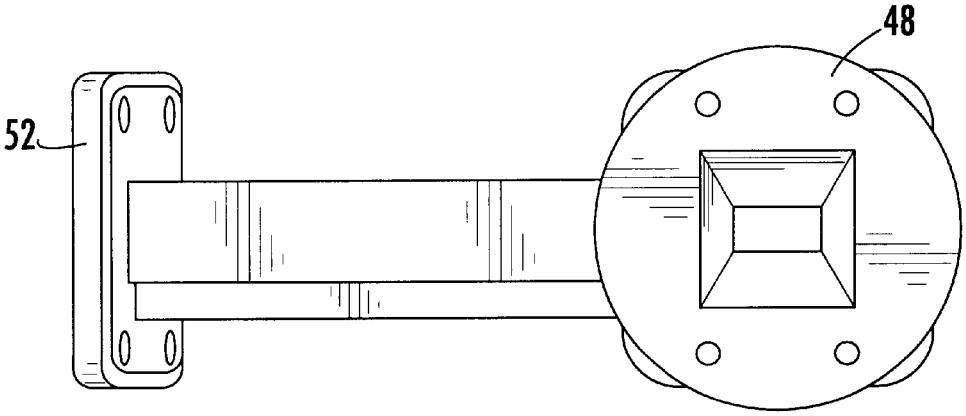
FIG. 5C is a view looking into the feed horn flange of a Ku-band co-pol diplexer.

Design drawings for one preferred Ku-band embodiment of co-pol diplexer 20 are provided in FIGS. 5A—5C. FIG. 5A is a cross-sectional view through the narrow waveguide wall showing the geometry of the waveguide structures associated with iris 33. Iris 33 is one particular form of generalized junction 32, and those skilled in the art will appreciate that other forms of junction 32 may also be employed to provide the signal-splitting function performed by iris 33. Critical dimensions for proper coupling of energy into uplink arm 40 and downlink arm 42 include the angle between the two arms, which is preferably seventy seven degrees in this embodiment. In addition, proper impedance match into the single-ridged waveguide channel of downlink arm 42 is provided by a section of narrowed waveguide width at iris 33.

The waveguide width in a portion of uplink arm 40 is carefully chosen so that the cut-off frequency of this narrower section of waveguide is higher than the downlink signal frequency. As a consequence, no downlink energy can propagate through uplink arm 40. The uplink signal frequency, however, is above the cut-off frequency of this narrower section and propagates through uplink arm 40. In the embodiment shown, a four-section quarter-wave width transition is provided in the waveguide uplink arm 40 to transition from the narrow section to the standard waveguide at transmitter flange 50.

As can be best seen from FIG. 5A, all interior cavities in co-pol diplexer 20 are accessible by at least one slideable mandrel and the apparatus may thus be manufactured using reusable-mandrel aluminum casting methods to yield an inexpensive, lightweight part.

In the embodiment shown in FIG. 5A, the waveguiding structure comprises a flared top portion, a stepped lower portion, and a right portion with a uniform cross-section. In this embodiment, all internal surfaces of co-pol diplexer 20 may be seen from at least one of the three points A, B or C and a set of three slideable mandrels may be used to manufacture co-pol diplexer 20. To manufacture a waveguiding structure having this configuration, mandrels 60, 62, and 64 are assembled and positioned relative to each other as shown in FIG. 5A. Co-pol diplexer 20 is then cast around mandrels 60, 62 and 64, such as in a sand mold or other casting mold as is well known in the art. After the aluminum or other conductive casting material has cooled and hardened, mandrels 60, 62 and 64 are disassembled and slideably removed from the casting. As is known in the art, machining operations may then be performed to remove excess aluminum material from the outside of co-pol diplexer 20, to form suitable flange surfaces, or to form mounting bosses or other features on co-pol diplexer 20.

The relative locations of bandpass tuning screws 44 and high pass tuning screws 46 in one embodiment are provided in FIG. 5B. FIG. 5C depicts the square-to-rectangular waveguide transition near feed horn flange 48 along with detail for feed horn flange 48.

A Ku-band implementation of the co-pol diplexer of the present invention has been constructed with excellent electrical performance. Over any given 750 MHz band within a downlink frequency range of 10.95 GHz to 12.75 GHz and an uplink frequency range of 13.75 GHz to 14.5 GHz, passband loss is less than 0.2 dB, uplink/downlink rejection is greater than 70 dB, downlink/uplink rejection is greater than 40 dB and passband VSWR is less than 1.3:1.

The co-pol diplexer 20 of the present invention improves significantly upon the design and fabrication methods for existing co-pol diplexers because all internal surfaces of co-pol diplexer 20 are visible from some point external to the co-pol diplexer. The co-pol diplexer 20 thus may be manufactured by low-cost reusable-mandrel casting techniques rather than the expensive electroforming or machined assembly techniques required to fabricate conventional co-pol diplexers.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A co-polarized diplexer for coupling a receiver and a transmitter to a single antenna so as to allow for the simultaneous transmission and reception of co-polarized signals, the co-polarized diplexer comprising:

a waveguiding structure defining a junction for separating a first signal having a first frequency and a second signal having a second frequency in the waveguiding structure, the first and second signals being co-polarized, the first frequency being different from the second frequency;

a first filter, operatively connected to the waveguiding structure, for filtering the first signal; and a second filter, operatively connected to the waveguiding structure, for filtering the second signal;

wherein all internal surfaces of the co-polarized diplexer are visible from external to the co-polarized diplexer and the co-polarized diplexer is of an integral cast construction.

2. The co-polarized diplexer of claim 1 wherein the waveguiding structure is a bifurcated waveguide.

3. The co-polarized diplexer of claim 1 wherein the first filter is oriented relative to the second filter at an angle of between seventy and ninety degrees.

4. The co-polarized diplexer of claim 1 wherein the first filter comprises a bandpass filter and the second filter comprises a high pass filter.

5. The co-polarized diplexer of claim 1 further comprising an aluminum casting.

6. The co-polarized diplexer of claim 1 wherein the first filter comprises a rectangular waveguide.

7. The co-polarized diplexer of claim 1 wherein the second filter comprises a rectangular waveguide.

8. The co-polarized diplexer of claim 1 wherein the co-polarized diplexer operates within the C-band.

9. The co-polarized diplexer of claim 1 wherein the co-polarized diplexer operates within the Ku-band.

10. The co-polarized diplexer of claim 1 wherein the co-polarized diplexer operates within the Ka-band.

11. The co-polarized diplexer of claim 1 wherein the co-polarized diplexer operates within the X-band.

12. A device for coupling a receiver and a transmitter to a single antenna to allow for simultaneous transmission and reception of co-polarized signals, comprising:

a bifurcated waveguiding structure including a junction, an uplink arm having a waveguide channel communicating with said junction and a downlink arm having a waveguide channel communicating with said junction, wherein said uplink arm, said downlink arm and said junction comprise an integral casting, and wherein the waveguide channel of one of said arms is of a uniform cross-section along its longitudinal extent and the waveguide channel of the other of said arms is of various cross-sections along its longitudinal extent.

13. A device according to claim 12, wherein all internal surfaces of said bifurcated waveguiding structure are visible from external to the waveguiding structure whereby the apparatus may be manufactured using reusable mandrel casting techniques.

14. A device according to claim 12, additionally including a narrowed section integrally formed in the waveguide channel of said uplink arm defining a high pass filter.

15. A device according to claim 12, wherein the waveguide channels of said uplink and downlink arms are oriented at an angle of between seventy and ninety degrees.

16. A device according to claim 12, wherein said waveguiding structure comprises an aluminum casting.

17. A device for coupling a receiver and a transmitter to a single antenna to allow for simultaneous transmission and reception of co-polarized signals, comprising:

a feed horn flange; and a bifurcated waveguiding structure communicatively connected to said feed horn flange for conveying signals therefrom, said waveguiding structure including a junction for separating an uplink signal from a downlink signal, the uplink signal being at a higher frequency than the downlink signal, an uplink arm having a waveguide channel communicating with said junction for conveying said uplink signal, and a downlink arm having a waveguide channel communicating with said junction for conveying said downlink signal, a narrowed section integrally formed in the waveguide channel of said uplink arm defining a high pass filter having a cut-off frequency higher than the downlink signal frequency, and wherein said uplink arm, said downlink arm and said junction comprise an integral casting.

18. A device according to claim 17, wherein all internal surfaces of said bifurcated waveguiding structure are visible from external to the waveguiding structure whereby the apparatus may be manufactured using reusable mandrel casting techniques.

* * * * *